United States Patent [19]

Kako et al.

[11] Patent Number: 4,516,508

[45] Date of Patent: May 14, 1985

[54] DESK APPARATUS

[75] Inventors: Mitumasa Kako; Michifumi Ishigami, both of Nagoya, Japan

[73] Assignee: Brother Kogyo Kabushiki Kaisha, Nagoya, Japan

[21] Appl. No.: 491,559

[22] Filed: May 4, 1983

[30] Foreign Application Priority Data

May 11, 1982 [JP] Japan ..... 57-68571[U]

[51] Int. Cl.[3] ..... A47F 5/12

[52] U.S. Cl. ..... 108/7; 108/9; 248/188.2; 248/456

[58] Field of Search ..... 108/7, 9, 10, 1, 6; 248/456, 455, 188.2, 649

[56] References Cited

U.S. PATENT DOCUMENTS

| | | | |
|---|---|---|---|
| 422,673 | 3/1890 | Werner | 248/455 |
| 1,258,120 | 3/1918 | Kaplan | 248/456 |
| 4,068,815 | 1/1978 | Losert | 248/188.2 |
| 4,113,212 | 9/1978 | Coriden | 248/455 X |
| 4,350,098 | 9/1982 | Shirono et al. | 108/6 |

*Primary Examiner*—Philip C. Kannan

*Attorney, Agent, or Firm*—Moonray Kojima

[57] ABSTRACT

An apparatus for selectively adjusting the angle of inclination of a work surface, such as a desk top, comprising a casing attached to the bottom side of one end of the work surface, with a foot device comprising a circular cylindrical part with positioning channels in the periphery thereof and a foot member extending therefrom and with the cylindrical part contained within the casing, an engaging member projecting in the inside of the casing and for locking selected ones of the channels, and resilient member for holding the cylindrical part against the engaging member, whereby manual rotation of the foot member to different locking positions of the channels and engaging member, enables adjustment of the length and angle of extension of the foot member outside of the casing, and thus determine the space between the work surface and a base, with the other end of the work surface being pivotally connected.

6 Claims, 10 Drawing Figures

DESK APPARATUS

BACKGROUND OF THE INVENTION

1. Field of the Invention

This invention relates to a desk apparatus having a work surface, such as a computer keyboard, and more particularly, to a desk apparatus having a device which is capable of adjusting the angle of inclination of the work surface.

2. Description of the Prior Art

It is generally known that a certain degree of inclination of a work surface of a desk is desirable to an operator from the viewpoint of ease of workability.

As described hereinafter, there has been proposed an angle adjusting mechanism for adjusting the angle of inclination of a work surface, such as depicted in FIGS. 1(A) and 1(B). This angle adjusting mechanism which is positioned toward the rear end of a desk work surface enhances workability by providing a certain angle of inclination to the work surface, in addition to a level position. However, disadvantageously, this prior art angle adjusting mechanism provides on a single non-level angle of inclination. Thus, the operator cannot choose among a plurality of angles of inclination and one which would be the most suitable for himself. Also, the prior art arrangement has other disadvantages, such as the force required to operate the mechanism is substantial, and the operation cannot be easily accomplished.

Accordingly, there is a deficiency in the art which needs correction, and improvement.

SUMMARY OF THE INVENTION

It is an object of the invention to overcome and eliminate the aforementioned and other disadvantages, defects and deficiencies of the prior art.

Another object is to provide a mechanism which can provide a plurality of inclination angles in a work surface, and which can be readily operated with a light operating force.

A further object is to provide a desk work surface inclination angle adjusting mechanism which allows an operator to freely operate the mechanism while the work surface is adjustable to an optimum angle of inclination.

A still further object is to provide an economical desk apparatus which uses fewer numbers of parts and has a simple structure.

According to the invention, there is provided a desk apparatus having a mechanism for adjusting the inclination of a work surface which comprises a casing attached to a bottom side of the work surface and comprising an upper casing and a lower casing, with a pair of elliptical holes on opposite sides of the casing at the boundary between the upper and lower casing, with an aperture at the bottom wall of the lower casing; a rotatable foot device positioned between the work surface and base of the desk, for supporting the work surface against the base, and comprising a circular cylindrical part having a plurality of positioning channels in the periphery thereof, a pair of shafts extending from the ends of the cylindrical part for holding rotatably the foot device, and a foot member extending from the cylindrical part, the foot device being held by the shafts within said hole and within the casing and positioned so that the foot member when rotated to different locked positions can extend outside of the casing; an engaging member disposed within the upper casing for engagement with the positioning channels to form a plurality of separate locking positions; and a resilient member for normally holding the cylindrical part against the engaging member. To operate the mechanism, the foot member is manually turned until the suitable locking position is reached, against the resilient force of the resilient means, with the shaft moving up or down in the elliptical holes to enable easy movement of the cylindrical part from one position channel to the next, until the desired distance between the base and working surface is obtained by the foot member.

DETAILED DESCRIPTION OF THE PREFERRED EMBODIMENTS

Figure 1A:
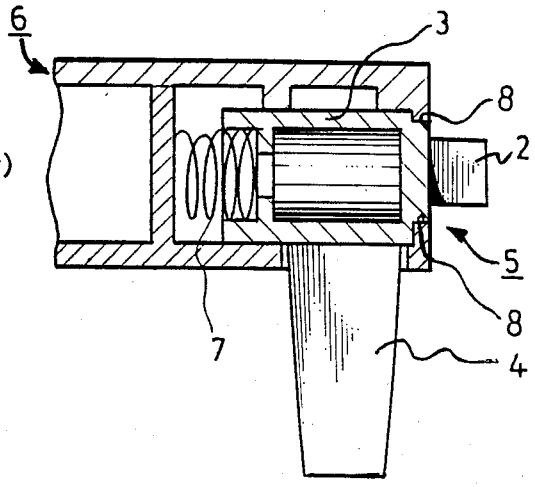
FIG. 1A (PRIOR ART)
FIGS. 1(A) and 1(B) depict a prior art adjusting mechanism for adjusting the angle of inclination of a work surface.
Figure 1B:
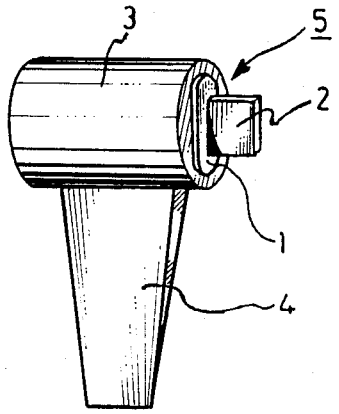
FIG. 1B (PRIOR ART)

FIGS. 1(A) and 1(B) depict a prior art angle adjusting mechanism for adjusting the angle of inclination of a work surface, such as a desk top used for computer terminals and keyboards, etc. The mechanism comprises a base end portion 3 having engaging portions 1, operation knob 2, foot member 5 comprising foot 4, casing 6, which rotatably supports foot member 5. Operation knob 2 of foot member 5 extends to the outside of casing 6. Spring portion 7 resiliently forces foot member 5 in a direction whereby engaging portion 1 of foot member 5 engages with engaging hole 8 provide on casing 6, with engaging portion 1 engaged with engaging hole 8, and foot 4 of foot member 5 extending from casing 6.

The mechanism is positioned toward one end of a work surface, such as a desk top, at a bottom side thereof, with the other end of the desk top pivotally held so that by extending foot member 6 between the desk top and a base, an incline will be formed of the desk top work surface.

The mechanism provides for only one locked position, in addition to a level position of the work surface. Thus, disadvantageously, an operator cannot select an angle best suited to his needs. Also, the force required to operate the mechanism, is substantial because the rotating movement is carried out by operating the knob 2, and by pushing or pulling the foor portion.

The illustrative embodiment improves upon the prior art and eliminates the aforementioned and other problems.

Turning now to FIGS. 2–7, there is depicted a mechanism for adjusting the angle of inclination of a work surface, which provides a plurality of locked positions for each of a plurality of different angles of inclination. FIGS. 3(A), 3(B) and 3(C) depict a box-like body 14 having an elongated holes 13 in opposite side walls thereof and walls which extend downward from upper side wall 12 on the inside of an upper casing 11, and a projection 15 extending downward from upper wall on the inside of box 14, as depicted. An opening 18 is provided at the bottom wall 17 of a lower casing 16. A pair of resilient spring like members or pieces 19,19 connected to a side wall holding horizontal wall 23, extends from one end of the opening 18. Box-like body 20 is formed and extends upward from opening 18. Box 20 fits together with box 14 to form a single box-like body when both casing 11 and 16 are fit together, as shown in FIGS. 2–7. Elongated holes 22,22 are formed at opposite side walls of box 20 as depicted. When the bottom and top boxes are fit together, the holes 13 and 22 combine to form elliptical holes 21,21 and are used to hold shaft 28. Cover 23 formed on a wall absent holes 13,22 extends toward the center of opening 18 and functions to reduce as much as possible exposure of the inside of the casing and mechanism to the outside. Casing 24 (see FIGS. 4–7) comprises upper casing 11 and lower casing 16.

Figure 3A:
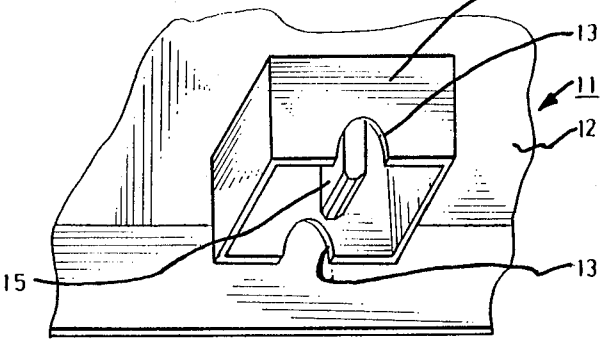
FIGS. 3(A), 3(B) and 3(C) are exploded perspective views depicting parts of the illustrative embodiment.
Figure 3B:
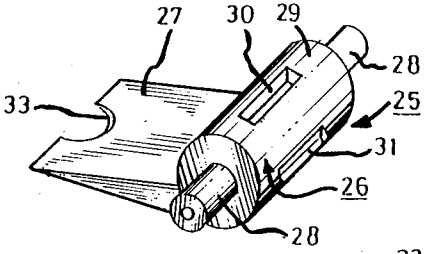
Figure 3C:
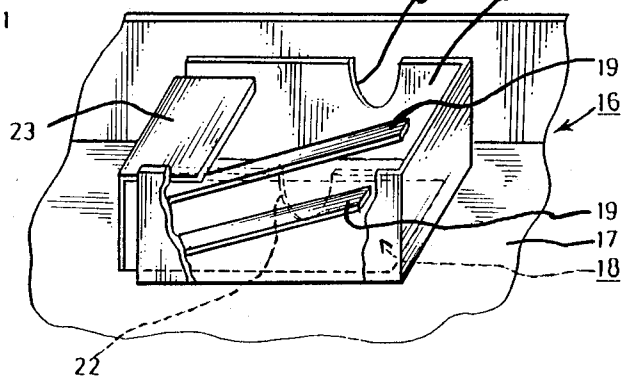

Inside casing 24 is foot device 25 (see FIG. 3(B)) which comprises a circular cylindrical base portion 26, having a circular cylindrical part 29 and axial shafts 28 extending from both ends thereof, and a foot member 27 extending from the base end portion 26. On the circumference of cylindrical part 29, there are three concave grooves 30,31,32 formed to provide position locking arrangements. The number of grooves may be increased as desired, for increased number of different angular inclination positions of the work surface. Foot member 27 is integral with base portion 26 and its unattached portion is provided with recess 33 of a suitable size for fitting a human finger. This foot device 25 is positioned within box resulting from fitting together of casing 11 and 16, with shaft 28 disposed to be rotatably supported by elliptical bearing holes 21, for both rotational and vertical movements. Foot device 25 is normally biased by resilient force of resilient pieces 19 for engaging of projection 15 into channel 30,31,32. Concurrently, foot member 27 will be projected outside of the casing 24 through opening 18, in non-level positions, such as when the engaging member 15 is engaged in channels 31 or 32. When engaging member 15 engages channel 30, however, the foot member will be within the casing.

Figure 2:
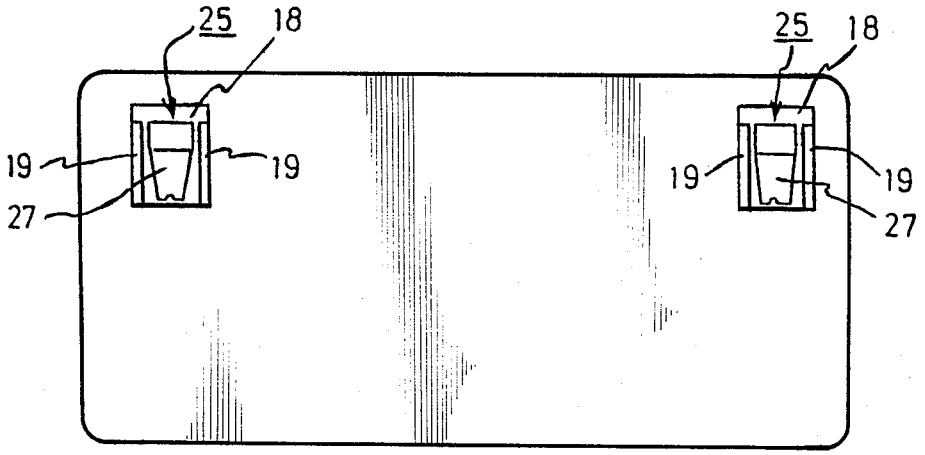
FIG. 2 is a bottom view depicting an illustrative embodiment of the invention as provided on the bottom side of a work surface.

As shown in FIG. 2, the foot device, which enables adjustment of the angle of inclination of a work surface, is connected or fixed to the bottom side of the work surface. Below the bottom side of the work surface, usually, there is a base, to which the foot member 27 will rest and support the work surface in a non-level position. In this embodiment, an operator can easily move the foot member 27 against the resilient force of spring 19, and engage or disengage the engaging member from channel 30,31,32, as desired, and thus engage or disengage the locking positions, and select the suitable foot member position vis-a-vis the work surface and base. The other end of the work surface is usually pivoted so that the different distances between the base and the work surface as determined by the foot member 27, will determine the angle of inclination.

The function and operation of the angle adjusting mechanism will now be more fully explained with reference to FIGS. 4–7.

Figure 4:
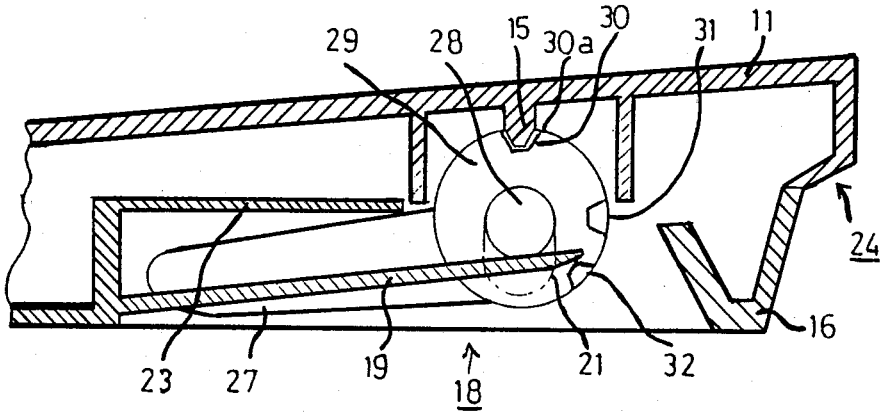
FIGS. 4, 5, 6 and 7 are enlarged elevational cross-sectional views of the illustrative embodiment.

FIG. 4 is an enlarged side sectional view indicating a level position of the foot device 25 positioned within casing 24. This corresponds to a level position of the work surface. Foot device 25 is shown locked in a position with projection 15 of upper case 11 engaged with concave channel 30. Base end portion 26 and its shaft 28, is biased upward by resilient force of spring 19, and held toward the upper end of bearing holes 21. In this manner, foot member 27 is held within the casing 24, and in a level position.

Figure 5:
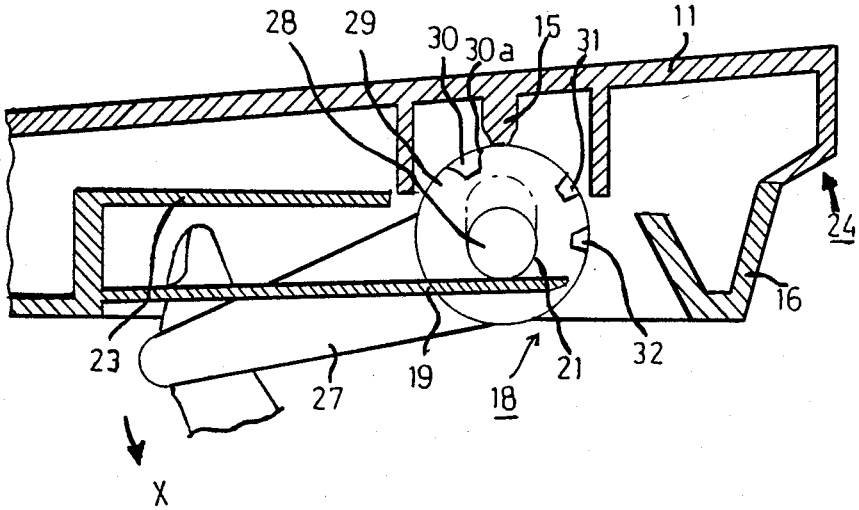

FIG. 5 is a view similar to FIG. 4, and showing a finger inserted into recess 33 of foot member 27, for rotating in the direction shown by arrow x, the foot device 25. As foot member 27 is rotated, the engagement between groove 30 and engaging member 15 is released. The channel or groove 30 is rounded at the surface 30*a*. Accordingly, foot member 27 can be easily rotated with only a slight finger pressure. Once engagement is released, base portion 26 is pressed downward against the resilient force of pieces 19, as much in length as the depth by which the projection 15 is engaged with channel 30. Thus, shaft 28 is moved toward the lower end of bearing holes 21. Under this condition, foot member 27 also rotates smoothly without any interference because the end point of projection 15 is in contact with the periphery of body 29.

Figure 6:
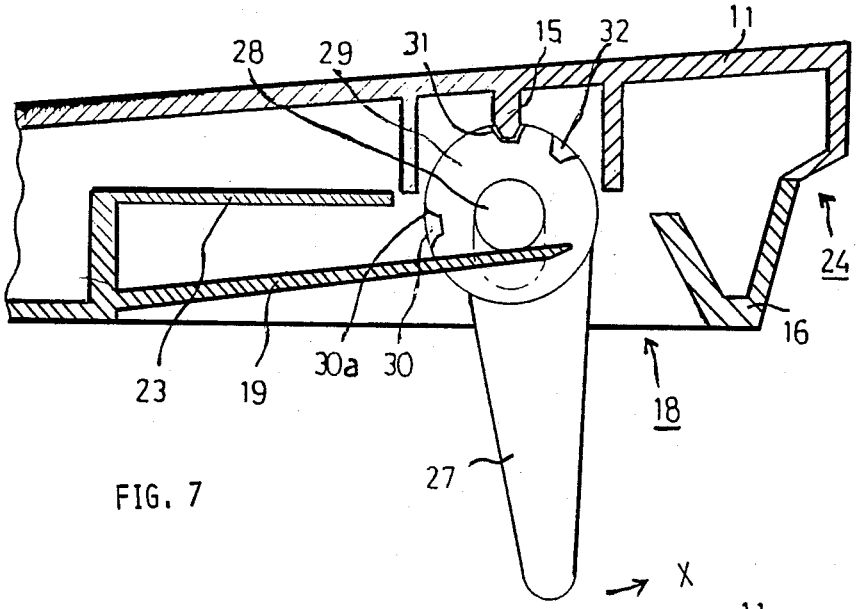

FIG. 6 is a view similar to FIGS. 4 and 5, and shows foot member 27 being further rotated in the direction indicated by arrow x, from the condition existing in FIG. 5, with projection 15 engaged in concave groove 31. Projection 15 engages groove 31 automatically since shaft 28 is also biased upward by elastic pieces 19. In this condition, the weight of the desk work surface and the adjusting mechanism is applied downward and shaft 28 is urged upward by the resilient force of pieces 19. Thus, engagement between projection 15 and groove 31 is more reliable and securely fixed.

Figure 7:
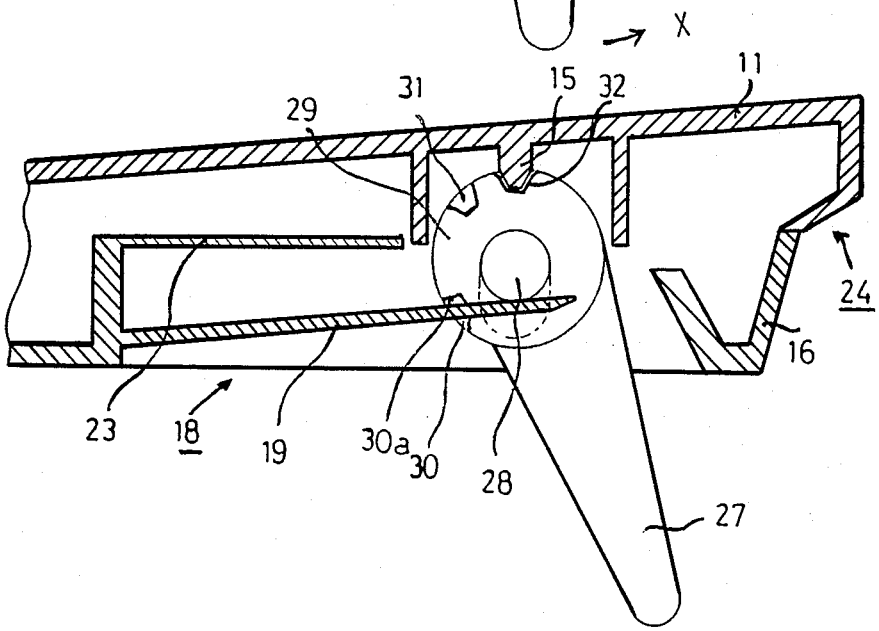

FIG. 7 is a view similar to FIGS. 4, 5, and 6, and shows foot device 25 locked in another position. Foot member 27 is further rotated counterclockwise from the locked condition shown in FIG. 6 with projection 15 engaged in concave groove 32.

Advantageously, an operator can freely select any one of a plurality of locked positions, such as shown in FIGS. 4, 6 or 7 as required or desired. In case foot device 25 is changed from one of the non-level locked conditions shown in FIG. 6 or 7, to an unused or level condition, shown in FIG. 4, the foot member 27 is manually rotated clockwise, with the disengagemenft of projection 15 from the channel 32 or 31, against the resilient force of spring 19, and with the shaft moving downward in hole 21 when the projection is outside the channel, and then to the next adjacent channel, until the desired channel is reached and engaged by member 15.

A preferred embodiment has just been described. Advantgeously, this embodiment makes possible the selection of one of a plurality of level and angular positions for the work surface, with only slight finger pressure for moving from one locked position to another, and enables manufacture of a simple and efficient reliable device.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. An angle adjusting mechanism for use in selectively adjusting the angle of inclination of a work surface and disposed between said work surface and a base, said mechanism comprising a casing comprising a lower casing and an upper casing, with a pair of elliptical holes formed on opposite side walls of said casing and in the area of the boundary between said upper casing and lower casing, said upper casing being attachable to said work surface and said lower casing being contactable with said base in a level position of said work surface;

a foot device positioned within said casing and comprising a cylindrical portion having a plurality of channels in the periphery thereof, a pair of shafts extending from both ends of said cylindrical portion, and a foot member extending from said periphery of said cylindrical portion and having an end thereof contactable with said base in inclined positions of said work surface;

an engaging member positioned within and attachable to said upper casing and above said cylindrical portion within contactable distance to said plurality of channels in said cylinder portion to determine the distance between the base and the work surface dependent on the particular one of said plurality of channels to which said engaging member is engaged, said distance determining said angle of inclination of said work surface; and resilient means for urging said cylindrical member against said engaging means, wherein said shafts are positioned within said elliptical holes to be rotatable and vertically movable therein so that in a level locked position of said work surface, said foot member is within the casing and said lower casing contacts said base, and the engaging member is engaged with one of said plurality of channels on the periphery of the cylindrical member, and so that in said inclined positions of said work surface the foot member is manually rotated outside of the casing and against the resilient force of said resilient means to disengage the engaging member from said one or other of said plurality of channels, until the cylindrical member presents another selected channel for engagement and said selected other channel is engaged by the engaging member with said foot member having said end portion thereof thereupon resting on said base at a selected distance from said work surface.

2. The mechanism of claim 1, wherein said foot member has a recess opening at the unattached end thereof for gripping by a human finger.

3. The mechanism of claim 1, wherein said resilient means causes said shaft to move vertically upward in said elliptical holes when engaging a selected channel, and against said resilient force, said shaft moves downward vertically when disengagement of said engaging member and said channel is taking place.

4. The mechanism of claim 1, wherein said resilient means comprises a pair of flat springs attached at one end thereof to a wall of said casing, and at the other end thereof held against said shaft.

5. The mechanism of claim 1, wherein said resilient means comprises a pair of elastic pieces formed integrally with a wall of said casing.

6. An angle adjusting mechanism for use in selectively adjusting the angle of inclination of a work surface and disposed between said work surface and a base, said mechanism comprising a casing comprising an upper casing in contact with said work surface and a lower casing, with a pair of elliptical holes formed on opposite side walls of said casing and in the area of the boundary between said upper casing and lower casing;

a foot device positioned within said casing and comprising a cylindrical portion having a plurality of channels in the periphery thereof, a pair of shafts extending from both ends of said cylindrical portion and positioned within said elliptical holes, and a foot member extending from said cylindrical portion, said foot member being within said casing in one position and rotatable outside of said lower casing in other positions, and in contact with said base so as to incline the work surface;

an engaging member positioned within said casing, engagable with a channel on the periphery of the cylindrical member and disengagable from the engaged channel until the cylindrical member presents another channel for engagement thereby; and resilient means for urging said cylindrical member against said engaging means and to position said shafts within said elliptical holes to be vertically movable therein and to be rotatable therein, thereby to selectively position said foot member in a desired position for selected inclination of the work surface, with said engaging means in a selected channel to lock said foot member in a position outside of said lower casing against said base for an inclined position of said work surface or in a position inside said lower casing for a level position of said work surface.

* * * * *